US011502415B2

(12) United States Patent
McMichael

(10) Patent No.: US 11,502,415 B2
(45) Date of Patent: Nov. 15, 2022

(54) MECHANICALLY RECONFIGURABLE PATCH ANTENNA

(71) Applicant: The MITRE Corporation, McLean, VA (US)

(72) Inventor: Ian T. McMichael, Stow, MA (US)

(73) Assignee: The MITRE Corporation, McLean, VA (US)

( * ) Notice: Subject to any disclaimer, the term of this patent is extended or adjusted under 35 U.S.C. 154(b) by 135 days.

(21) Appl. No.: 17/020,054

(22) Filed: Sep. 14, 2020

(65) Prior Publication Data

US 2021/0066806 A1 Mar. 4, 2021

Related U.S. Application Data

(63) Continuation of application No. 15/897,624, filed on Feb. 15, 2018, now Pat. No. 10,777,894.

(51) Int. Cl.

| | |
|---|---|
| ***H01Q 1/38*** | (2006.01) |
| ***H01Q 9/04*** | (2006.01) |
| ***H01Q 1/52*** | (2006.01) |

(52) U.S. Cl.

CPC ..... *H01Q 9/0428* (2013.01); *H01Q 1/521* (2013.01); *H01Q 9/045* (2013.01)

(58) Field of Classification Search

CPC ..... H01Q 9/0428; H01Q 1/521; H01Q 9/045
See application file for complete search history.

(56) References Cited

U.S. PATENT DOCUMENTS

| | | | |
|---|---|---|---|
| 4,554,549 A | 11/1985 | Fassett et al. | |
| 9,270,026 B2 | 2/2016 | Kyriazidou | |
| 9,537,214 B2 | 1/2017 | Corman et al. | |
| 10,283,868 B1 * | 5/2019 | Breed | H01Q 9/0442 |
| 2004/0119642 A1 | 6/2004 | Truthan | |
| 2005/0206568 A1 | 9/2005 | Phillips et al. | |
| 2007/0241969 A1 | 10/2007 | Andrenko | |
| 2013/0300602 A1 | 11/2013 | Zhou et al. | |
| 2017/0179581 A1 | 6/2017 | Puuri et al. | |
| 2018/0331428 A1 | 11/2018 | Iino | |

FOREIGN PATENT DOCUMENTS

| | | | |
|---|---|---|---|
| CN | 103441340 A | | 12/2013 |
| JP | H0856116 A | * | 2/1996 |
| JP | 2003-110347 A | | 4/2003 |

OTHER PUBLICATIONS

Bai, Xu-Dong et al. (2017) "Experimental Array for Generating Dual Circularly-Polarized Dual-Mode OAM Radio Beams," Scientific Reports, 7:40099, DOI:10.1038/srep4009; 8 pages.

(Continued)

*Primary Examiner* — Dieu Hien T Duong

(74) *Attorney, Agent, or Firm* — Morrison & Foerster LLP

(57) ABSTRACT

A polarization configurable patch antenna including a radiating layer, wherein the radiating layer has a corner truncated rectangular patch shape; and a feed capacitively coupled to the radiating layer for exciting the radiating layer, wherein the radiating layer is rotatable with respect to the feed, and the antenna is configured to generate a right-hand circularly polarized radiation field when the radiating layer is in a first rotational position and a left-hand circularly polarized radiation field when the radiating layer is in a second rotational position.

17 Claims, 9 Drawing Sheets

(56) References Cited

OTHER PUBLICATIONS

Behdad, Nader et al. (2006) "Dual-Band Reconfigurable Antenna With a Very Wide Tunability Range," IEEE Transactions on Antennas and Propagation, vol. 54, No. 2; 8 pages.
Bernhard, Jennifer T. et al. (2001) "A Smart Mechanically Actuated Two-Layer Electromagnetically Coupled Microstrip Antenna with Variable Frequency, Bandwidth, and Antenna Gain," IEEE Transactions on Antennas and Propagation, vol. 49, No. 4; 5 pages.
Costantine, Joseph et al. (2009) "The Analysis of a Reconfigurable Antenna With a Rotating Feed Using Graph Models," IEEE Antennas and Wireless Propagation Letters, vol. 8; 4 pages.
Hum, Sean Victor et al. (2010) "Analysis and Design of a Differentially-Fed Frequency Agile Microstrip Patch Antenna," IEEE Transactions on Antennas and Propagation, vol. 58, No. 10; 9 pages.
Kovitz, Joshua M. et al. (2015) "Design and Implementation of Broadband MEMS RHCP/LHCP Reconfigurable Arrays Using Rotated E-Shaped Patch Elements," IEEE Transactions on Antennas and Propagation, vol. 63, No. 6; 11 pages.
Lin, Shun-Yun et al. (2011) "Patch Antenna with Reconfigurable Polarization," Proceedings of the Asia-Pacific Microwave Conference; 4 pages.
Lin, Wei et al. (2016) "Polarization Reconfigurable Aperture-Fed Patch Antenna and Array," IEEE Access, vol. 4; 8 pages.
Lin, Wei et al. (2017) "Multipolarization-Reconfigurable Circular Patch Antenna With L-Shaped Probes," IEEE Antennas and Wireless Propagation Letters, vol. 16; 4 pages.
Lin, Wei et al. (2017) "Wideband Circular-Polarization Reconfigurable Antenna With L-Shaped Feeding Probes," IEEE Antennas and Wireless Propagation Letters, vol. 16; 4 pages.
Liu, L. et al. (2008) "Liquid crystal tunable microstrip patch antenna," Electronics Letters, vol. 44, No. 20; 2 pages.
Majid, Huda A. et al. (2012) "A Compact Frequency-Reconfigurable Narrowband Microstrip Slot Antenna," IEEE Antennas and Wireless Propagation Letters, vol. 11; 4 pages.
Mazlouman, S. Jalali et al. (2011) "Pattern reconfigurable square ring patch antenna actuated by hemispherical dielectric elastomer," Electronics Letters, vol. 47, No. 3; 2 pages.
Mazlouman, Shahrzad Jalali et al. (2012) "Square Ring Antenna With Reconfigurable Patch Using Shape Memory Alloy Actuation," IEEE Transactions on Antennas and Propagation, vol. 60, No. 12; 8 pages.
McMichael et al., U.S. Office Action dated Mar. 18, 2020 directed to U.S. Appl. No. 15/897,624; 8 pages.
McMichael et al., U.S. Office Action dated Sep. 6, 2019 directed to U.S. Appl. No. 15/897,620; 8 pages.
McMichael, Ian T. (2017) "A Mechanically Reconfigurable Patch Antenna with Polarization Diversity," IEEE; 5 pages.
Nassar, Ibrahim T. et al. (2013) "Radiating Shape-Shifting Surface Based on a Planar Hoberman Mechanism," IEEE Transactions on Antennas and Propagation, vol. 61, No. 5; 4 pages.
Nishamol, M. S. et al. (2011) "An Electronically Reconfigurable Microstrip Antenna With Switchable Slots for Polarization Divewrsity," IEEE Transactions on Antennas and Propagation, vol. 59, No. 9; 4 pages.
Panagamuwa, C. J. et al. (2008) "Antenna Frequency and Beam Reconfiguring using Photoconducting Switches," IET; 6 pages.
Peroulis, Dimitrios et al. (2005) "Design of Reconfigurable Slot Antennas," IEEE Transactions on Antennas and Propagation, vol. 53, No. 2; 10 pages.
Pozar, D. M. et al. (1988) "Magnetic Tuning of a Microstrip Antenna On a Ferrite Substrate," Electronics Letters, vol. 24, No. 12; 3 pages.
RajyaLakshmi, Dr. V. (2016) "Polarization Reconfigurable Antenna," International Journal of Electronics and Communication Engineering & Technology, 7(3); 6 pages.
Rao, B. Rama et al. (2013) "GPS/GNSS Antennas," Boston: Artech House, pp. 290-292.
Sun, Chao et al. (2014) "A Compact Frequency-Reconfigurable Patch Antenna for Beidou (COMPASS) Navigation System," IEEE Antennas and Wireless Propagation Letters, vol. 13; 4 pages.
Tawk, Y. et al. (2010) "A Frequency Reconfigurable Rotatable Microstrip Antenna Design," IEEE; 4 pages.
Tawk, Y. et al. (2011) "Implementation of a Cognitive Radio Front-End Using Rotatable Controlled Reconfigurable Antennas," IEEE Transactions on Antennas and Propagation, vol. 59, No. 5; 6 pages.
Zhang, M. et al. (2017) "Tunable Polarization Conversion and Rotation based on a Reconfigurable Metasurface," Scientific Reports, 7:12068, DOI:10.1038/s41598-017-11953-z; 7 pages.
Zhao, Yizhe et al. (2017) "A Frequency and Pattern Reconfigurable Antenna Array Based on Liquid Crystal Technology," IEEE Photonics Journal, vol. 9, No. 3; 8 pages.
Zhu, H. L. et al. (2014) "Design of Polarization Reconfigurable Antenna Using Metasurface," IEEE Transactions on Antennas and Propagation, vol. 62, No. 6; 8 pages.

* cited by examiner

MECHANICALLY RECONFIGURABLE PATCH ANTENNA

CROSS-REFERENCE TO RELATED APPLICATIONS

This application is a continuation of U.S. application Ser. No. 15/897,624, filed Feb. 15, 2018, the entire contents of which are incorporated herein by reference.

STATEMENT REGARDING FEDERALLY SPONSORED RESEARCH OR DEVELOPMENT

This invention was made with Government support under U.S. Government contract FA8702-17-C-0001 awarded by the U.S. Department of the Air Force. The Government has certain rights in this invention.

FIELD OF THE DISCLOSURE

This invention relates generally to radio-frequency antennas and, more specifically, to circularly polarized patch antennas.

BACKGROUND OF THE DISCLOSURE

Wireless systems typically require a defined set of antenna characteristics, such as frequency, polarization, and gain pattern. However, some applications may require varying antenna characteristics to suit a shifting environment or a set of scenarios that may not have predefined requirements. In such cases, it may be more convenient and cost effective to utilize a reconfigurable antenna than multiple antennas. For example, an application may require an antenna that can be used to receive left-hand circular polarized (LHCP) signals in some situations and right-hand circular polarized (RHCP) signals in other situations and a single configurable antenna may be advantageous over a multi-antenna solution.

Many types of reconfigurable antennas have been developed. Some are based on electrical tuning or switching utilizing varactors, PIN diodes, or RF MEMS switches. These electronic devices are used for shorting or opening sections of the antenna to affect its polarization or its resonant frequency. Other reconfigurable antenna designs have utilized optical devices or substrate materials with tunable characteristics like electric field tunable liquid crystals or magnetic field tunable ferrites. Mechanically reconfigurable antennas have also been designed using actuators or manual reconfiguration. While reconfigurable antennas using electronic devices or mechanical actuation have the advantage of agility, manually reconfigurable antennas can be very low cost and employed without external biasing or power requirements.

SUMMARY OF THE DISCLOSURE

According to some embodiments, a microstrip patch antenna includes a corner truncated rectangular patch that is rotatable relative to a feed so that the antenna can be manually configured for either RHCP or LHCP polarizations by rotating the patch. The antenna may include a ground plane, a first substrate located on the ground plane, and a second substrate located on the first substrate such that the second substrate is rotatable relative to the first substrate. The corner truncated patch may be disposed on a top surface of the rotatable substrate and a feed may be located between the fixed and rotatable substrates. The feed capacitively couples to the patch without contacting the patch. The location of the feed relative to the truncated corners of the patch determines the direction of polarization such that rotation of the patch by ninety degrees results in switching from RHCP to LHCP and vice versa. This design enables polarization diversity in a very simple package without complex electrical biasing or external power that is typically required for reconfigurability.

According to some embodiments, a polarization configurable patch antenna includes a radiating layer, wherein the radiating layer has a corner truncated rectangular patch shape; and a feed capacitively coupled to the radiating layer for exciting the radiating layer, wherein the radiating layer is rotatable with respect to the feed, and the antenna is configured to generate a right-hand circularly polarized radiation field when the radiating layer is in a first rotational position and a left-hand circularly polarized radiation field when the radiating layer is in a second rotational position.

In any of these embodiments, the second rotational position may be offset 90 degrees from the first rotational position. In any of these embodiments, the feed may be located at least partially underneath the radiating layer.

In any of these embodiments, the feed may be located at least partially underneath a midline of a first side of the radiating layer when the radiating layer is in the first rotational position and at least partially underneath a midline of a second side of the radiating layer when the radiating layer is in the second rotational position.

In any of these embodiments, the radiating layer may have two truncated corners located diagonally opposite one another. In any of these embodiments, the radiating layer may be rotatable about a rotational axis that extends centrally through the radiating layer.

In any of these embodiments, the radiating layer may be located on a rotatable substrate such that the radiating layer is rotatable with the rotatable substrate, and the rotatable substrate may separate the radiating layer and the feed.

In any of these embodiments, the antenna may further include a ground plane and a fixed substrate located between the ground plane and the rotatable substrate, wherein at least a portion of the feed is located between the fixed substrate and the rotatable substrate and is fixed relative to the fixed substrate.

In any of these embodiments, the rotatable and fixed substrates may be insulators.

In any of these embodiments, the feed may include a first portion that extends through the fixed substrate and a second portion that extends parallel to the radiating layer. In any of these embodiments, the second portion of the feed may terminate at a first distance from the rotational axis and the first portion of the feed is at a second distance from the rotational axis that is greater than the first distance.

In any of these embodiments, a ground portion of the feed may be electrically connected to the ground plane. In any of these embodiments, the feed may be an L-shaped probe. In any of these embodiments, the feed may be electrically isolated from the radiating layer.

In any of these embodiments, a shaft may extend through the radiating layer.

In any of these embodiments, the antenna may include at least one catch for registering the radiating layer in at least one of the first and second positions. In any of these embodiments, the radiating layer may be disposed on a rotatable substrate and the at least one catch may include a detent that fits into a receptacle for registering the rotatable substrate. In any of these embodiments, the feed may include the detent and the receptacle may be a recess on an underside of the rotatable substrate.

In any of these embodiments, the antenna may have a single feed. In any of these embodiments, the radiating layer may be configured as a square patch.

BRIEF DESCRIPTION OF THE FIGURES

The invention will now be described, by way of example only, with reference to the accompanying drawings, in which.

DETAILED DESCRIPTION OF THE DISCLOSURE

Figure 1:
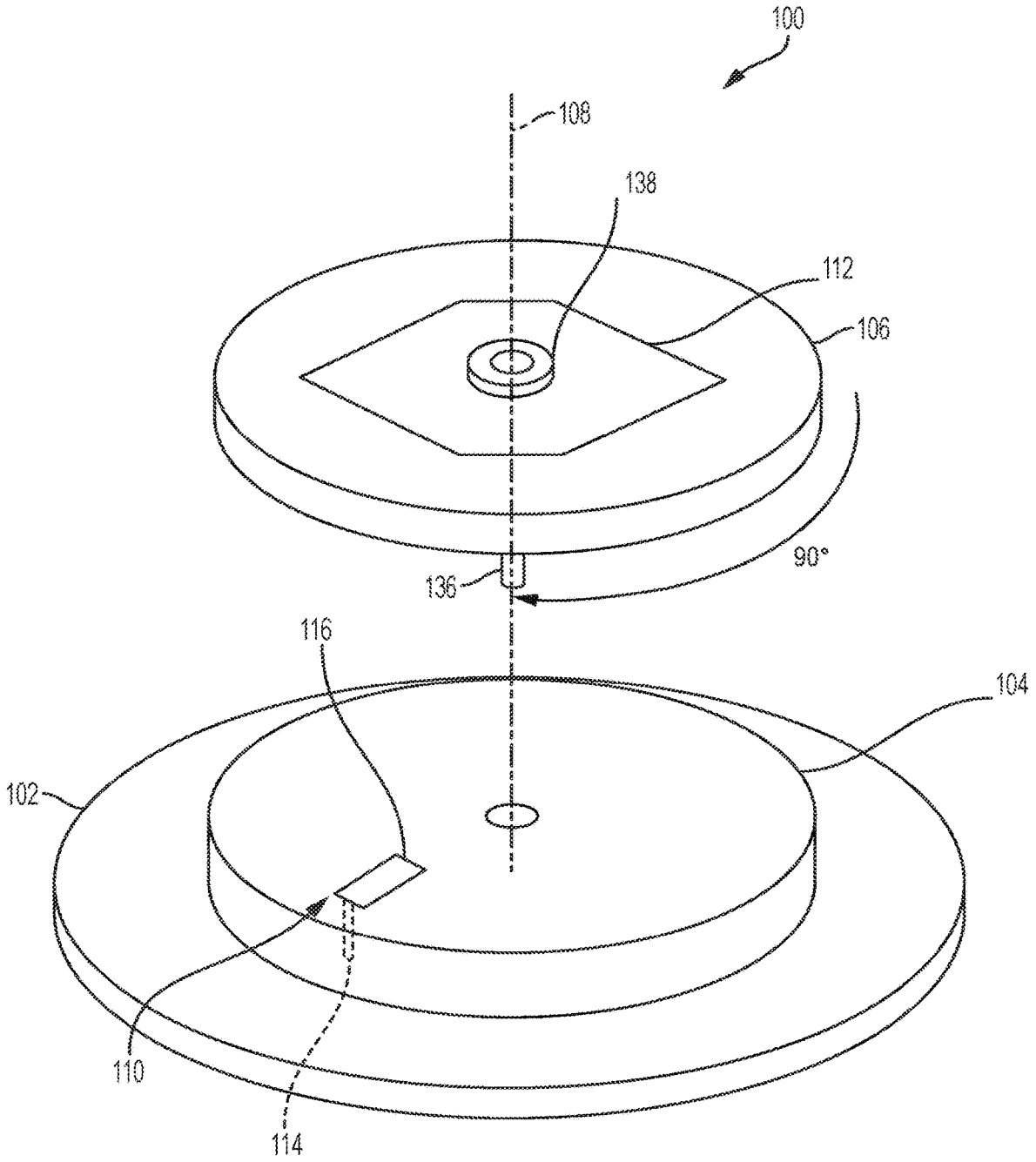
FIG. 1 is an exploded view of a polarization reconfigurable patch antenna, according to some embodiments.

Described herein are polarization configurable truncated-corner patch antennas for providing polarization diversity without complex and expensive electronic components or actuators. According to some embodiments, the antenna can be configured for either right-hand circular polarization or left-hand circular polarization by simply rotating a radiating patch portion of the antenna by ninety degrees. The lower portion of the antenna includes a feed that capacitively excites the patch without contacting the patch, which allows the radiating patch to rotate. An advantage of this design compared to other mechanically reconfigurable designs is that polarization diversity is achieved with fewer structures. This implementation can be lower cost and easier to fabricate compared to conventional designs. Additionally, according to some embodiments, the feed structure can efficiently excite a variety of patch sizes so that a set of patches with various resonant frequencies can be manufactured and swapped in and out since the radiating patch portion of the antenna is not permanently fixed.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or"," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Reference is made herein to antennas including radiating elements of a particular size and shape. For example, certain embodiments of radiating element are described having a shape and a size compatible with operation over a particular frequency range. Those of ordinary skill in the art would recognize that other shapes of antenna elements may also be used and that the size of one or more radiating elements may be selected for operation over any frequency range in the RF frequency range (e.g., any frequency in the range from below 20 MHz to above 50 GHz).

Reference is sometimes made herein to generation of an antenna beam having a particular shape or beam-width. Those of ordinary skill in the art would appreciate that antenna beams having other shapes may also be used and may be provided using known techniques, such as by inclusion of amplitude and phase adjustment circuits into appropriate locations in an antenna feed circuit and/or multi-antenna element network.

Standard antenna engineering practice characterizes antennas in the transmit mode. According to the well-known antenna reciprocity theorem, however, antenna characteristics in the transmit mode correspond to antenna characteristics in the receive mode. Accordingly, the below description provides certain characteristics of antennas operating in a transmit mode with the intention of characterizing the antennas equally in the receive mode.

FIG. 1 is an exploded view of a reconfigurable patch antenna 100 according to one embodiment. As detailed below, the antenna can be selectively configured for right-hand and left-hand circular polarization by rotating the radiating layer of the antenna relative to one or more stationary feeds for exciting the radiating layer.

Antenna 100 includes a ground plane 102, a lower substrate 104 that is stationary with respect to the ground plane 102, and an upper substrate 106 that is rotatable with respect to the lower substrate 104 about a rotation axis 108. A corner truncated rectangular microstrip radiating layer 112 (also referred to herein as a patch) is provided on the upper substrate 106. A feed 110 is disposed on the lower substrate 104 and is configured to provide an excitation signal to the radiating layer 112. The antenna 100 can be configured for either right-hand circular polarization or left-hand circular polarization by rotating the radiating layer 112 and the upper substrate 106 on which it is disposed by 90 degrees. This changes the location of the truncated corners relative to the feed 110, which results in a change in the direction of circular polarization.

According to some embodiments, a shaft 136 may extend through the upper substrate 106 so that the upper substrate 106 is rotatable but translationally fixed relative to the lower substrate 104. The antenna 100 may be configured with a null in the center such that the shaft 136 does not affect the antenna's electric field distribution. The upper substrate 106 may be rotationally positioned by any other suitable means such as by positioning the upper substrate 106 within a ring-shaped frame.

The upper substrate 106 may rest atop the lower substrate 104 such that the lower substrate 104 provides the bearing surface upon which the upper substrate 106 rotates or may be spaced from the lower substrate 104, for example, by a bearing or bushing. To switch the antenna from the RHCP configuration to the LHCP configuration (and vice versa), a user may grasp the upper substrate 106 and rotate it ninety degrees in either direction.

In some embodiments, a bolt extending through the ground plane and first and second substrates serves as the shaft 136. A nut 138 may be provided on the bolt to hold the lower and upper substrates together and, in some embodiments, to prevent the upper substrate 106 from rotating out of position. In some embodiments, a user may loosen the bolt to rotate the upper substrate 106 for reconfiguration. In some embodiments, the nut 138 is not loosened and, instead, the compliance of the stack of substrates allows the upper substrate 106 to be rotated by a user while still being held in position when no rotational force is applied.

Figure 2:
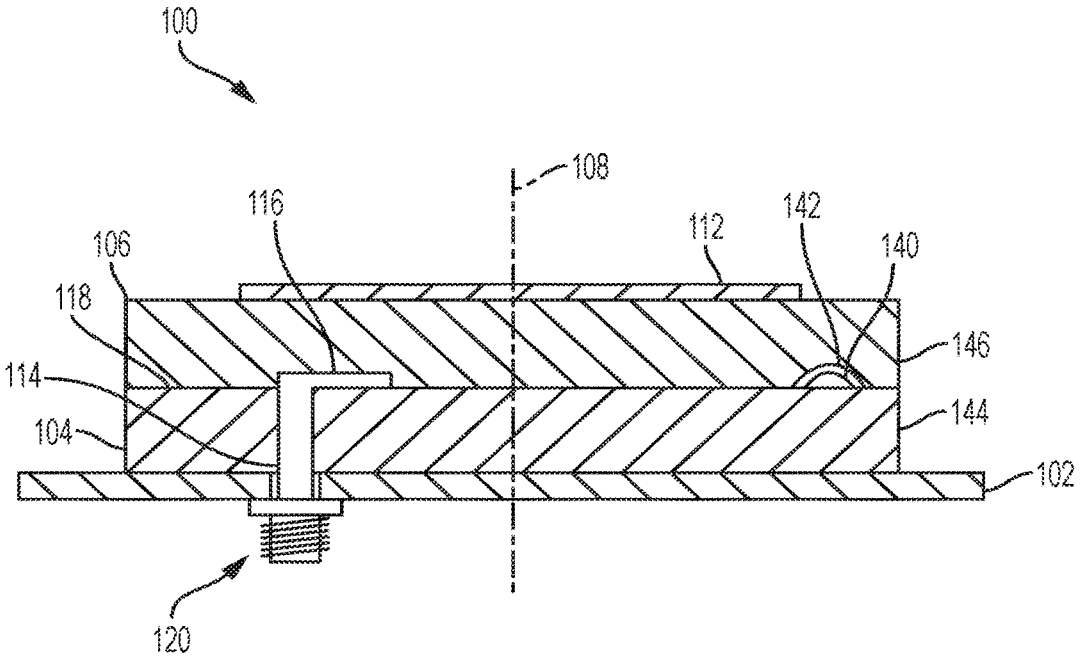
FIG. 2 is a cross section of a polarization reconfigurable patch antenna, according to some embodiments.

FIG. 2 is a cross section of antenna 100 in an assembled state illustrating a position of the feed 110 relative to the radiating layer 112, according to one embodiment. A first portion 114 of the feed 110 extends through the thickness of the lower substrate 104 from a connector 120. The connector 120 includes a ground portion that is conductively connected to the ground plane and a signal portion that is conductively connected to the first portion 114 of the feed 110. A feed wire, such as a coaxial cable, can be connected to the connector 120 to provide a signal to the antenna 100.

A second portion 116 of the feed 110 extends along the upper surface 118 of the lower substrate 104. The second portion 116 of the feed is at least partially underneath the radiating layer 112 such that a line extending perpendicularly through the radiating layer 112 intersects the second portion 116 of the feed. The second portion 116 of the feed 110 may extend inwardly from the first portion 114 toward the axis 108, terminating at point F. The second portion 116 capacitively couples to the radiating layer 112 to provide an excitation signal but does not contact the radiating layer 112. This allows the upper substrate 106 and radiating layer 112 to be rotated about axis 108 while the feed 110 remains stationary.

The second portion 116 is separated from the radiating layer 112 at least by the thickness of the overlying portion of the upper substrate 106. In some embodiments, there may be some other structure, such as for providing a bearing surface, or an air gap that separates the first portion 114 and the overlying portion of the upper substrate 106. The second portion 116 of the feed 110 may be disposed on the upper surface 118 of the lower substrate 104 or may be disposed within a recess in the upper surface 118 of the lower substrate 104.

As will be understood by a person of skill in the art, the location of the termination point F of the feed 110 is generally selected for impedance matching. The location of the termination point F may be moved closer to or further from the rotational axis 108 (which runs through the center C of the patch) depending on the particular design requirements. In some embodiments, the entire feed 110 is beneath the radiating layer 112 and in other embodiments, the first portion 114 of the feed 110 is outside of the footprint of the radiating layer 112 such that the second portion 116 of the feed 110 crosses beneath an edge of the radiating layer 112, as in the embodiment shown in FIG. 2. In some embodiments, the first portion 114 of the feed 110 is at a distance from the rotational axis 108 that is greater than the distance from the feed point F to the rotational axis 108. In some embodiments, the first portion 114 of the feed 110 extends in a direction that is parallel to the rotational axis 108 and the second portion 116 extends in a direction that is perpendicular to the rotational axis 108.

According to some embodiments, antenna 100 may include one or more features to register the upper substrate 106 in the positions for LHCP and RHCP. For example, one or more catches may be included to mechanically register the upper substrate 106. A catch may include one or more features provided on one or both of the upper and lower substrates. For example, a detent 140 protruding from the upper surface of the lower substrate 104 may fit into in a first recess 142 in the bottom of the upper substrate 106 to register the upper substrate in the position for LHCP and may fit into a second recess (not shown) in the bottom of the upper substrate 106 that is ninety degrees offset with respect to the first recess 142 to register the upper substrate 106 in the position for RHCP. In some embodiments, markers may be provided to indicate the correct rotational position for the upper substrate. For example first and second vertical lines may be provided on the edge face 144 of the first substrate at positions that are ninety degrees offset with one another and a vertical line may be provided on the edge face 146 of the upper substrate 106 such that alignment of the line on the upper substrate 106 with either of the lines on the lower substrate 104 registers the upper substrate 106 is in the proper angular position for RHCP or LHCP.

Figure 3B:
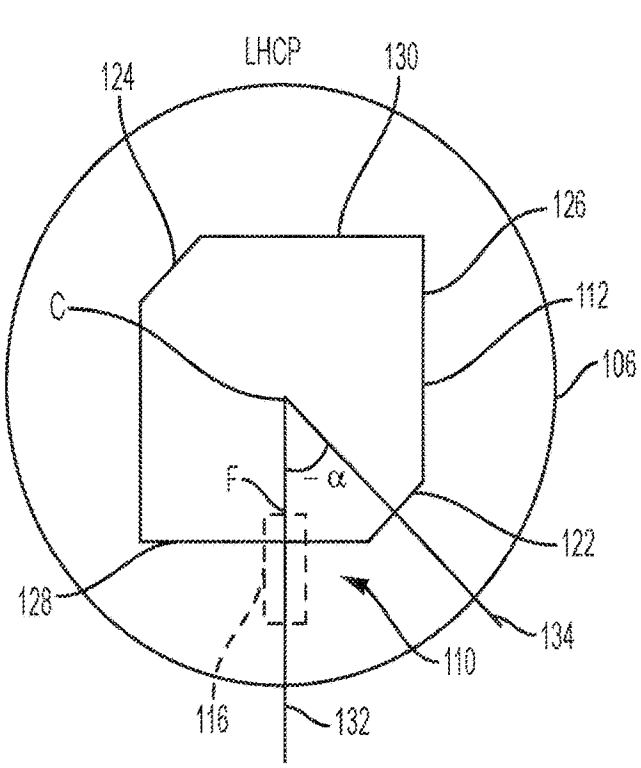
FIG. 3B is a plan view of the polarization reconfigurable patch antenna of FIG. 3A in a left-hand circular polarization configuration.
Figure 3A:
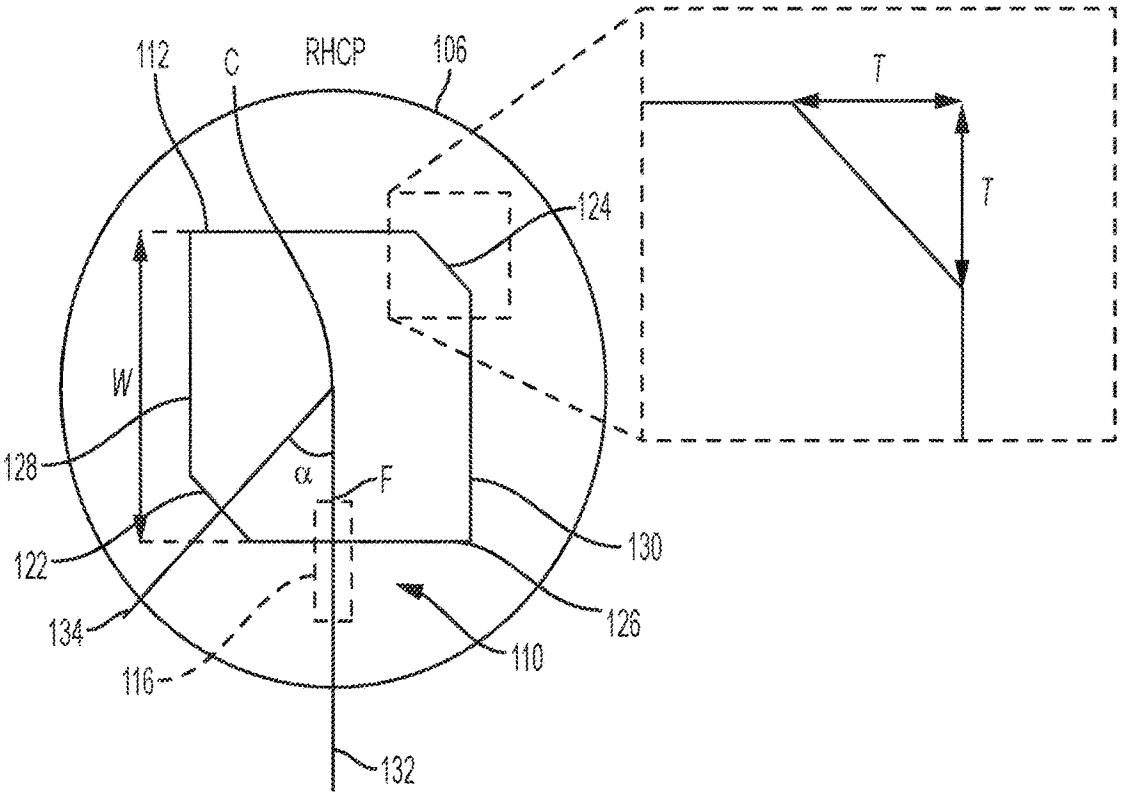
FIG. 3A is a plan view of a polarization reconfigurable patch antenna in a right-hand circular polarization configuration, according to some embodiments.

FIGS. 3A and 3B shows the location of the feed 110 relative to the corner truncated patch radiating layer 112 for configuring the antenna for right-hand and left-hand circular polarization, according to some embodiments. The view shown in these figures is from above looking down onto the radiating layer 112 with the feed 110 shown in dashed lines to indicate that it is underneath the upper substrate 106 from the point of view shown in the figures.

The radiating layer 112 may be shaped as a rectangular corner truncated patch. The patch may be square with two of the corners 122 and 124 located diagonally opposite one another being truncated. A rectangular patch has a length of L and a width of W and is fed at a feed point F. The degree to which the feed 110 extends beneath the radiating layer 112 and, thus, the location of feed point F is generally selected for impedance matching as mentioned above. As is well known in the art, the resonant frequency of a rectangular patch antenna is roughly determined by the length L of the rectangular patch. For example, the length L of the rectangular patch may be set to approximately $\lambda/2$ when the resonant wavelength of the antenna is $\lambda$. The width W of the rectangular patch is generally proportional to the bandwidth of the antenna. The length L and the width W of the rectangular patch may be equal to each other—i.e., a square patch—such that the resonant frequency and the bandwidth remain substantially the same when the patch is rotated from the right-hand circularly polarized orientation to the left-hand circularly polarized orientation and vice versa. Thus, according to some embodiments, the resonant frequency in the RHCP configuration is substantially the same as the resonant frequency in the LHCP configuration.

Two diagonally opposite corners (122 and 124) of the rectangular patch are truncated, with the truncated portion of a corner being in the form of an isosceles right triangle having a side length t. Electrical lengths from the feed point F to the sides of the rectangular patch are different from each other because of the truncated portions, and thus two resonant modes are obtained. Since circular polarization is achieved when the two resonant modes have a phase difference of 90 degrees between them, the antenna 100 can be selectively configured for right-hand circular polarization and left-hand circular polarization by controlling the position of the truncated corners relative to the feed point.

FIG. 3A shows the right-hand circular polarization configuration of the antenna 100 with the radiating layer 112 in a first rotational position. In this configuration, the feed 110 extends beneath a first side 126 of the radiating layer 112 midway between the edge of a second side 128 and the edge of a third side 130 (i.e., directly beneath a midline through the first side 126) such that a plane 132 extending orthogonally to the radiating layer midway through the second portion 116 of the feed 110 and from the center C of the radiating layer 112 is equidistant from the edges of the second and third sides. When viewing the radiating layer side of the antenna (the view shown in FIG. 3A), the truncated corner 122 that is nearest the feed 110 is located forty-five degrees clockwise from the feed. In other words, an angle $\alpha$ in the plane of the radiating layer between plane 132 and a line 134 extending from the center C of the radiating layer 112 midway through truncated corner 122 is about forty-five degrees.

FIG. 3B shows the left-hand circular polarization configuration with the radiating layer 112 in a second rotational position. Relative to the RHCP configuration of FIG. 3A, the radiating layer 112 has been rotated ninety degrees counterclockwise. The feed 110 is now underneath the second side 128 and truncated corner 122 is forty-five degrees counterclockwise from the feed 110 as viewed from the face having the patch 124—i.e., $\alpha$ equals forty-five degrees counterclockwise. According to some embodiments, the direction of rotation of the radiating layer 112 to switch from the RHCP orientation to the LHCP can be either clockwise or counterclockwise due to the symmetry of the radiating layer 112.

As would be well understood by one of skill in the art, the frequency response and radiation patterns of antenna 100 can be "tailored" by selecting appropriate design parameters, including the length, width, and thickness of the radiating layer, the dimensions of the truncated corners, the thickness and dielectric constant of the lower and upper substrates, and the feed configuration. This flexibility in design allows antennas according to the principals described herein to be used in numerous applications.

Figure 4:
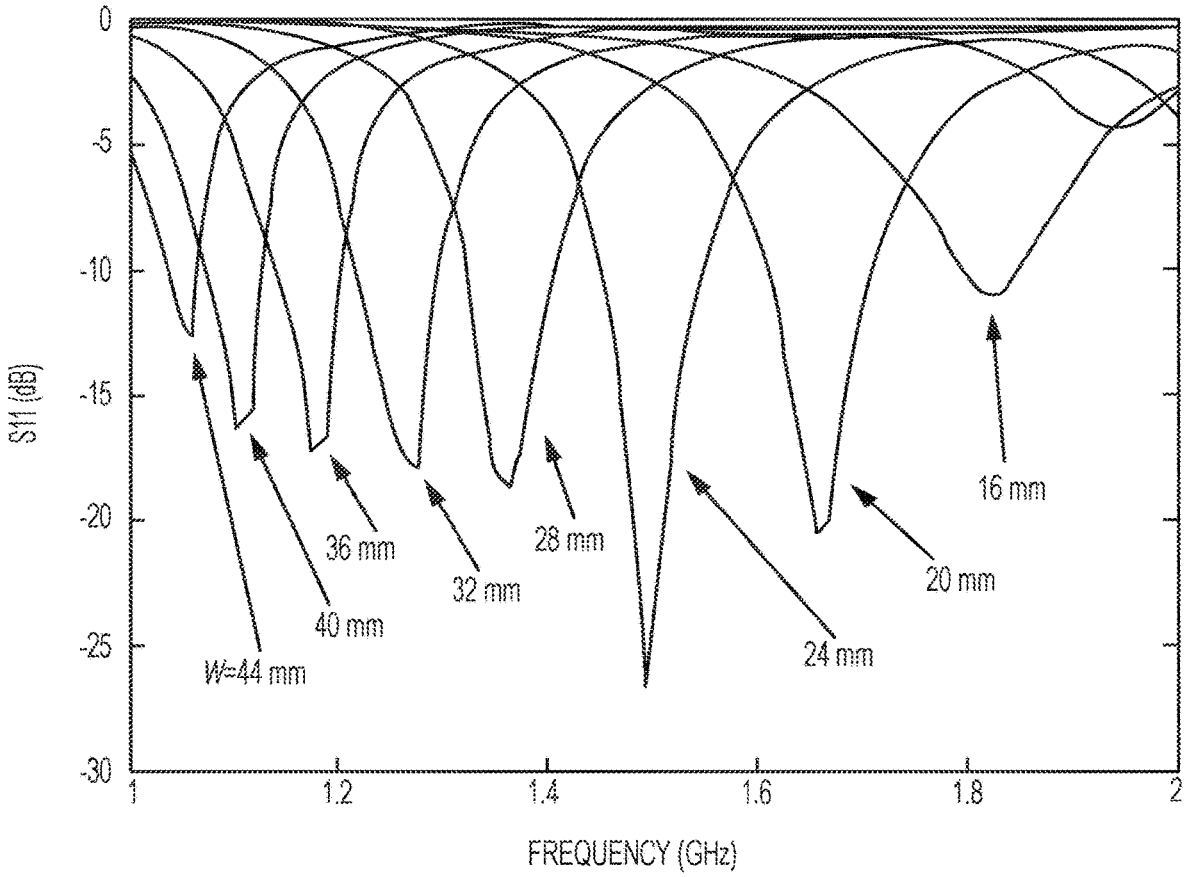
FIG. 4 is a simulated reflection coefficient plot for a range of patch sizes of a polarization reconfigurable patch antenna according to some embodiments.

According to some embodiments, the feed 110 of antenna 100 can efficiently excite a variety of patch sizes. Thus, since the radiating patch portion of the antenna may not be permanently fixed, a set of patches of different sizes having different resonant frequencies can be manufactured and swapped in and out to satisfy a range of design requirements. FIG. 4 shows a reflection coefficient plot for a range of patch sizes according to one embodiment of antenna 100. The parameter W indicates the width of the square patch. The feed is the same for all patch sizes represented in FIG. 4. The plot shows that the antenna is impedance matched for a range of patch sizes such that the antenna can be used for applications requiring resonant frequencies ranging from about 1 GHz to 1.8 GHz simply by swapping out patches. For example, to use the antenna modeled in FIG. 4 for an application requiring a nominal frequency of 1.5 GHz, an upper substrate with a patch having a 28 mm width can be swapped in. To then use the antenna for an application requiring a nominal frequency of 1.8 GHz, the 28 mm patch (and substrate) can be swapped out for the 16 mm patch (and substrate).

According to some embodiments, such as antenna 100, the antenna can be fed by a single feed due to the corner truncated patch design of the radiating layer. In some embodiments, the radiating field characteristics of the antenna can be improved by including a second feed positioned 180 degrees from feed 110. In operation, the second feed is fed by a signal that is 180 degrees out of phase relative to the signal feeding feed 110. By including a second feed line, the radiating field can be more uniform around the azimuth.

As would be well understood by one of skill in the art, the performance of a polarization reconfigurable patch antenna can depend on the materials selected for the various components. In some embodiments, the ground plane 102 is a metal plate providing both grounding and structural strength to the antenna and may be made of copper, copper alloys, aluminum, aluminum alloys, steel, or any other suitable metal. In some embodiments, the ground plane 102 is a thin layer of metal deposited on a base-plate, such as a dielectric substrate material or an engineering plastic. The base-plate can provide structural rigidity with lower weight than a metallic base-plate. Substrates can be composed of any suitable insulating material, including glass, ceramic, engineering plastics, Taconic TLP-3, FR4, RO3002, RO6002, RO5880, and RO5880LZ. Different materials may be used for different substrates within an antenna.

Figure 5:
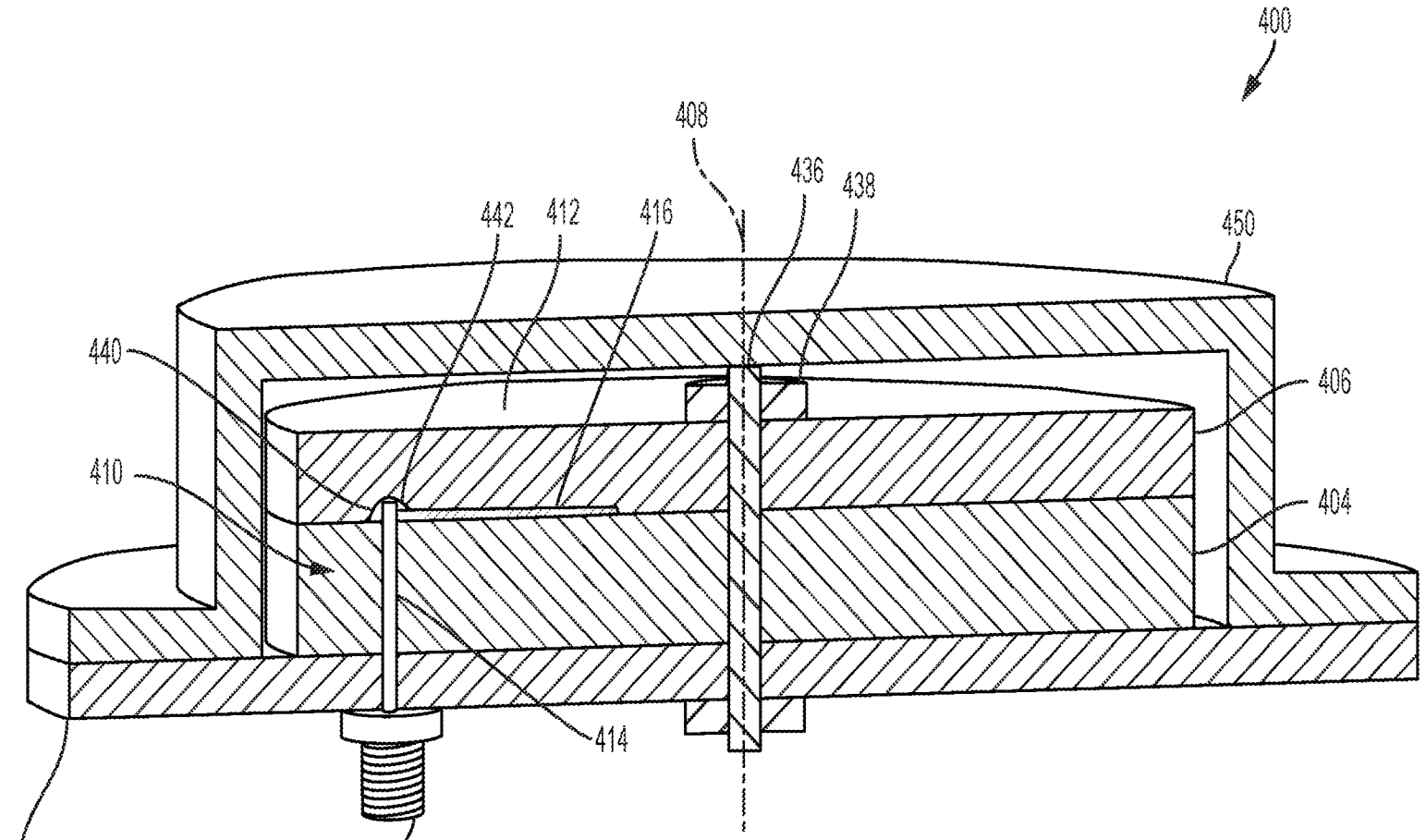
FIG. 5 is a cross section of a polarization reconfigurable patch antenna, according to some embodiments.

Radiating layers and ground planes can be formed as conducting films, such as metal films (e.g., aluminum, copper, gold, silver, etc.), deposited on the underlying substrate. In some embodiments, one or more radiating layers and/or ground planes are formed of sheet metal or machined metal. In some embodiments, the radiating layer is a free standing sheet of metal without an underlying substrate. The radiating layer may be mounted on a shaft that locates it such that an air gap is formed between the radiating layer Example of a Mechanically Reconfigurable Antenna An example of a mechanically reconfigurable antenna is illustrated in FIG. 5. The mechanically reconfigurable antenna 400 includes a square patch radiating layer 412 with truncated corners on an upper substrate 406 and an L-probe feed 410 on a lower substrate 404. The two layers are held together with a bolt 436 that goes through the center of the antenna 400, forming a shaft for enabling rotation of the upper substrate 406 about rotational axis 408. A null in the electric field distribution at the center of the antenna 400 allows inclusion of the metal bolt 436 through the middle without significant affects to the performance of the antenna. A cover 450 covers the substrate stack for protection.

The lower substrate 404 is fixed to a ground plane 402, while the upper substrate 406, with patch 412, can rotate when a nut 438 on the bolt 436 is loosened. The clocking of the truncated corners of patch 412 with respect to the L-probe feed 410 determines the handedness of the circular polarization, as discussed above with respect to FIGS. 3A and 3B.

The patch 412 in this example was arbitrarily chosen to resonate at 1.3 GHz. The patch 412 can easily be removed and replaced with a different sized patch to resonate at a different frequency. Since the antenna is excited with a non-contact L-probe feed 410, the patch can be replaced quickly with minimal cost and effort.

The L-probe feed 410 includes a vertical wire 414 extending from an SMA connector 420 located on the underside of the ground plane 402 to the top surface of the lower substrate 404. A horizontal strip of copper tape 416 (which in this example is 11 mm×4 mm) on the lower substrate 404 is soldered to the wire 414, completing the L-shape. The L-probe feed 410 is impedance matched to a range of patch sizes such that the L-probe feed 410 does not need to be modified to accommodate a range of resonant frequencies from approximately 1.0-1.8 GHz, as illustrated in FIG. 4.

In order for the square patch 412 to support circular polarization, diagonally opposite corners of the patch are truncated as discussed above. The depth of the truncation, t, is dependent on the patch width W. The optimum truncation dimensions to support circular polarization in this example were determined using iterative numerical simulations for a range of patch widths. A linear function was then fit to the resulting data to derive a closed form expression for the truncation depth, as follows:

$$t = W*0.316-3.6 \text{ mm}$$

where the variables W and t are as illustrated in FIG. 3A. It should be noted that this equation was empirically derived with a specific substrate material and radome cover.

The dielectric substrate material of the lower substrate 404 and the upper substrate 406 is Rogers TMM10i, with a dielectric constant of 9.8 and a loss tangent of 0.002. The lower substrate 404 is 0.3 inches tall and the upper substrate 406 is 0.2 inches tall. Both of the substrates are circular with diameters of 2.4 inches.

The polycarbonate cover 450, which covers the substrates for protection, has a thickness of 0.125 inches. The cover affects the antenna resonance and, thus, is considered when tuning the patch. The supporting ground plane 402 is 3.5 inches in diameter.

The lower and upper substrates 404, 406 were manufactured from a sheet of Rogers TMM 10i. A hole was drilled through the center of both substrate disks to accommodate the bolt 436. For the feed 410, a pin extends from the connector 420 on the underside of the ground plane 402 to slightly above the lower substrate 404 such that the upper portion 440 of the pin protrudes upwardly. A divot 442 is formed in the underside of the upper substrate 406 for receiving the protruding L-probe to register the upper substrate 406 in the correct orientation for one polarization configuration. A second divot (not shown) is provided at a location 90 degrees from the divot 442 for registering the upper substrate 406 for the other polarization configuration.

A printed circuit board (PCB) with continuous metal layer on the top side serves as the ground plane 402 for the antenna 400. In some embodiments, the bottom side of the PCB hosts amplifier and filtering electronics. There is a hole in the center of the PCB for the bolt 436 that holds the upper and lower substrates and the PCB together.

Figure 6:
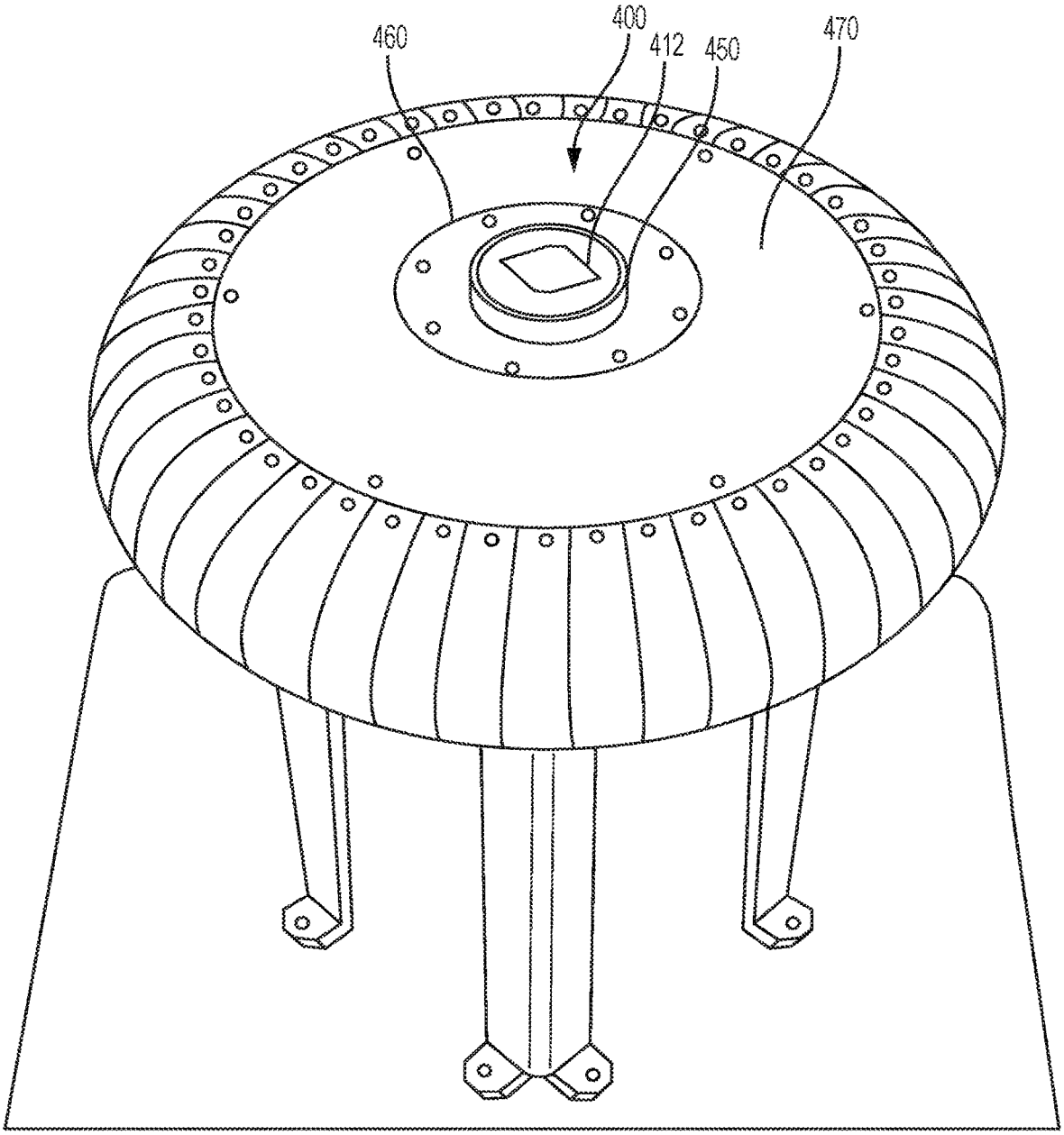
FIG. 6 shows the antenna of FIG. 5 mounted on a rolled edge ground plane.

The upper and lower substrate and ground plane PCB assembly fit into an aluminum bottom enclosure 460, as shown in FIG. 6. The bottom enclosure 460 shields the electronics and holds an external SMA connector. The bottom enclosure 460 is configured to ensure electrical continuity from the antenna ground plane 402 to any external ground plane that touches the enclosure, like the 15-inch rolled edge ground plane 470 shown in FIG. 6. The rolled edge ground plane 470 can be used to prevent ripples in the antenna pattern due to edge diffraction, as is known in the art. The polycarbonate top cover 450 is attached to the ground plane PCB and the bottom enclosure 460 with screws around the periphery. Mounting holes are included to attach the assembly to the external ground plane 470.

Figure 7A:
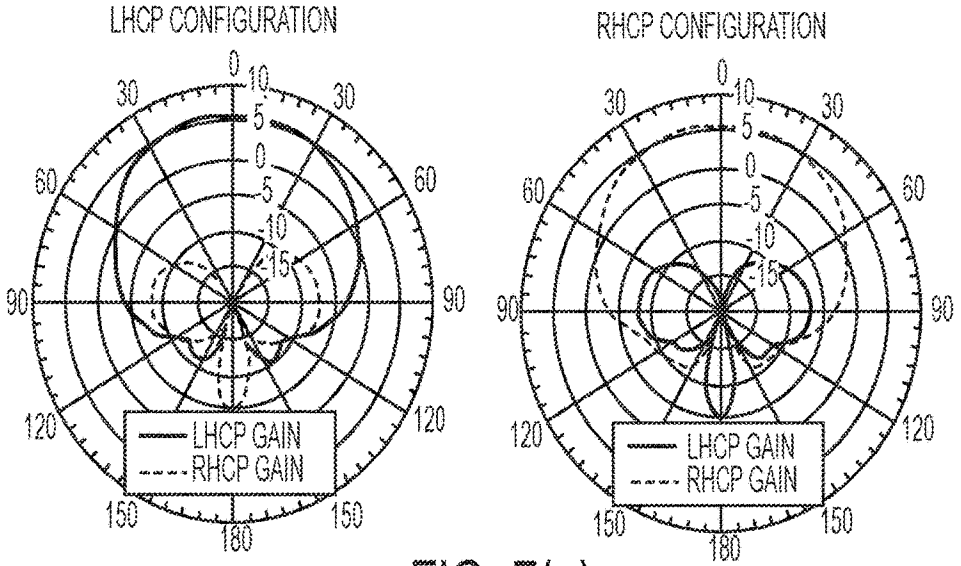
FIG. 7A shows plots of simulated gain pattern for the RHCP and LHCP configurations of a model of the antenna of FIG. 5.
Figure 7B:
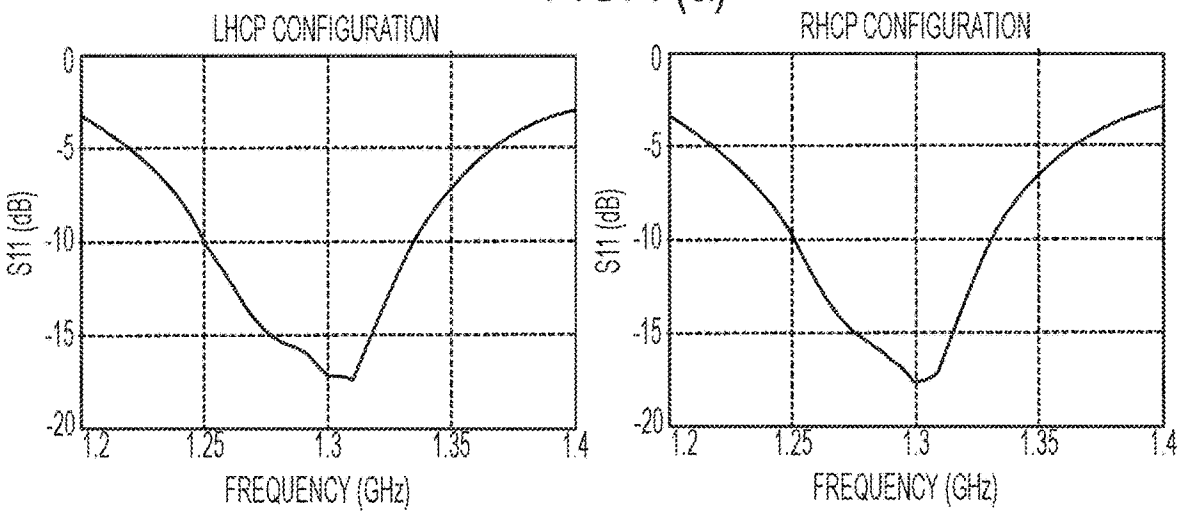
FIG. 7B shows plots of simulated reflection coefficients of the model.

The reconfigurable patch antenna 400 packaged and mounted as described above was modeled using ANSYS HFSS, a commercial full-wave electromagnetic solver, using a patch size, W=30.5 mm, that is configured to resonate at 1.3 GHz. Simulations were run with the simulated patch rotated for RHCP and for LHCP. FIGS. 7A and 7B shows the simulated gain patterns and reflection coefficients, respectively, for both polarization configurations. The modeled antenna's ground plane is modeled resting on a 15-inch diameter rolled edge ground plane to replicate the test setup for antenna 400 described below. In the plots, it can be seen that the results are identical for both the LHCP and RHCP simulations except that the handedness of the polarization is opposite. In this particular embodiment, the peak gain is 5.5 dBiC at zenith, the reflection coefficient has a −10 dB S11 bandwidth of 6.5%, and the axial ratio is 0.7 dB at zenith for both polarization configurations.

Figure 8B:
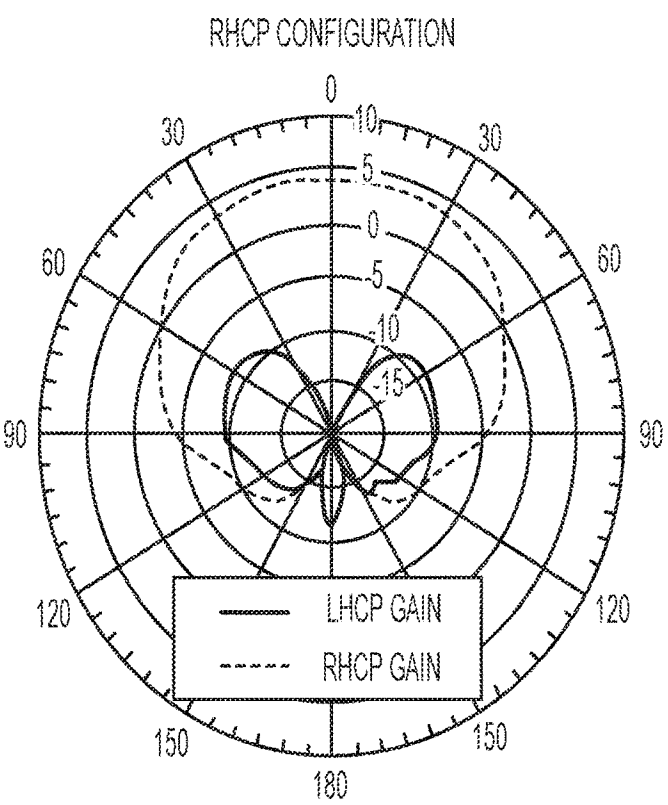
FIG. 8A shows the measured gain patterns of the antenna of FIG. 5 mounted on a rolled edge ground plane with the antenna in the LHCP configuration and FIG. 8B shows the measured gain patterns with the antenna in the RHCP configuration.
Figure 8A:
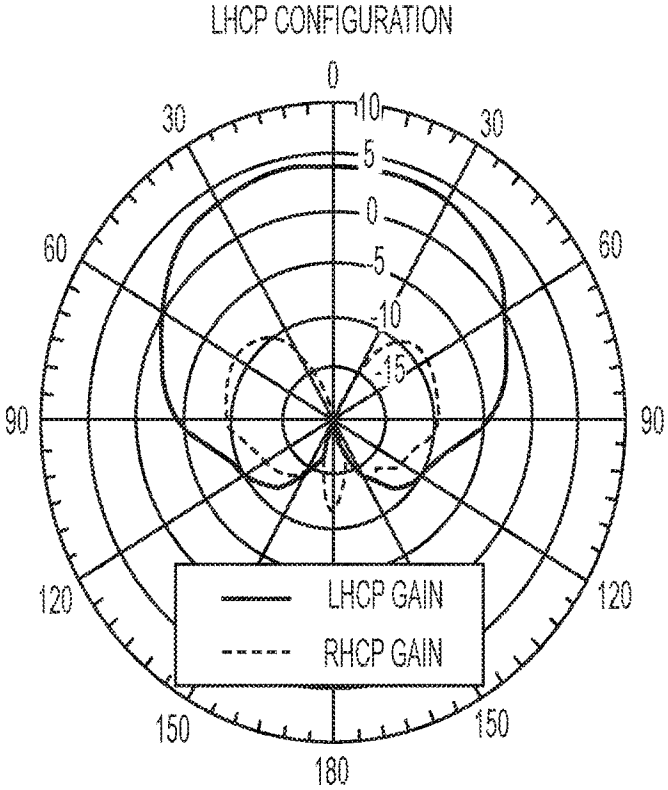
Figure 9:
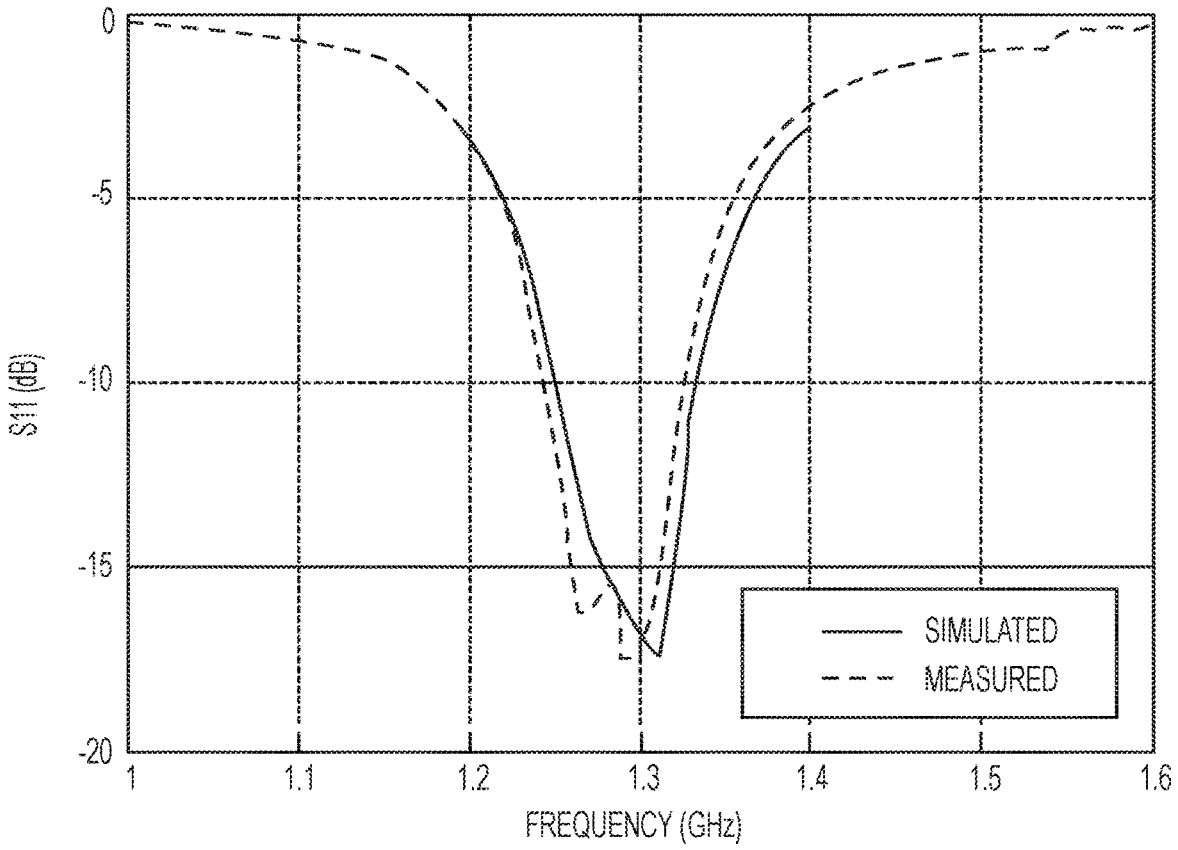
FIG. 9 is a comparison of the measured and simulated reflection coefficients for the antenna of FIG. 5 and the model, respectively.

The built antenna 400 packaged and mounted as described above was measured in both RHCP and LHCP configurations in an anechoic chamber with a NSI-MI spherical (roll over azimuth) near-field scanner system. FIG. 8A shows the measured gain pattern without any additional electronic gain for the LHCP configuration. FIG. 8B shows the measured gain pattern for the RHCP configuration. The patterns for the two configurations are nearly identical except for switching the handedness of the circular polarization. Comparison of the simulated gains in FIGS. 7A, B and the measured gain in FIGS. 8A,B shows agreement between the simulated and real-world performances. FIG. 9 is a comparison of the measured and simulated reflection coefficient showing that the measured and simulated performances are also in agreement.

As described above, the polarization (RHCP or LHCP) of antenna 400 is changed by loosening the nut 438 on the center bolt 436 and rotating the upper substrate 406 and patch 412 by 90 degrees. This method of mechanical polarization diversity requires fewer components compared to conventional polarization reconfigurable antennas and has no electronic biasing or power requirements. This polarization reconfigurable design is very easy to fabricate and is very low cost due to the simple architecture.

Reference is made herein to a radiating layer that is rotatable relative to (or with respect to) the feed. This phrase is intended to refer to relative movement of the radiating layer and feed. In a global sense, either the radiating layer or the feed can be rotatable and the other fixed. In the embodiments described above, the rotatable portion is the radiating layer (and upper substrate); however, in some embodiments, the radiating layer is fixed and the feed is rotatable. For example, the lower portion of the antenna—e.g., the feed, lower substrate, and ground plane—may be rotatable and the upper substrate may be mounted to a housing or enclosure that fixes the upper substrate and the radiating layer disposed thereon. A user may then grasp the lower portions of the antenna and rotate them to change the direction of polarization according to the principals described above. Embodiments in which the lower portion of the antenna is rotatable may be advantages when access to the antenna is from below such as when the antenna is mounted in a roof of a vehicle.

The description above describes embodiments in which a user manually rotates the radiating layer portion of the antenna relative to the feed. However, in some embodiments, an actuator and control circuit may be included to reconfigure the antenna. For example, the upper substrate may be mounted on a shaft extending through the lower substrate and base plane and the shaft may be mounted to a motor, such as a stepper motor. A control system can control the motor to rotate the upper substrate and radiating layer to the proper rotational position for the desired polarization direction. A user may simply make a polarization selection, such as through a software setting or via a manual switch, and the control system may control the motor to set the proper rotational position of the radiating layer relative to the feed.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A polarization configurable patch antenna comprising:

a radiating layer disposed on a first substrate, wherein the radiating layer has a corner truncated rectangular patch shape and wherein the radiating layer is configured to have a null in a center of the radiating layer;

a shaft for enabling rotation of the radiating layer about a rotational axis, wherein the shaft extends orthogonally through the radiating layer; and a feed capacitively coupled to the radiating layer for exciting the radiating layer.

2. The antenna of claim 1, wherein the rotational axis extends centrally through the radiating layer.

3. The antenna of claim 1, wherein the shaft enables rotation of the first substrate about the rotational axis.

4. The antenna of claim 3, wherein the rotational axis is spaced from the feed so that the rotational axis does not pass through the feed, and wherein the radiating layer and the first substrate are rotatable relative to the feed.

5. The antenna of claim 4, wherein the antenna is configured to generate a right-hand circularly polarized radiation field when the radiating layer is in a first rotational position relative to the feed and a left-hand circularly polarized radiation field when the radiating layer is in a second rotational position relative to the feed.

6. The antenna of claim 5, wherein the second rotational position is offset 90 degrees from the first rotational position.

7. The antenna of claim 5, comprising at least one catch for registering the radiating layer in at least one of the first and second positions.

8. The antenna of claim 7, wherein the at least one catch comprises a detent that fits into a receptacle for registering the rotatable substrate.

9. The antenna of claim 3, comprising a second substrate, wherein the first substrate is disposed on the second substrate.

10. The antenna of claim 9, wherein the second substrate is stationary such that the first substrate is rotatable relative to the second substrate.

11. The antenna of claim 1, wherein the shaft extends orthogonally through the first substrate.

12. The antenna of claim 1, wherein the feed extends through a second substrate and the first substrate is translationally fixed relative to the second substrate.

13. The antenna of claim 12, wherein the shaft is a bolt.

14. The antenna of claim 13, wherein each of the first substrate and the second substrate comprises a hole to accommodate the bolt.

15. The antenna of claim 13, wherein the bolt is configured to hold the first substrate and the second substrate together.

16. The antenna of claim 13, comprising a nut on the bolt, wherein the nut is configured to prevent the first substrate from rotating out of position.

17. The antenna of claim 16, wherein the nut is loosened to allow rotation of the first substrate when a rotational force is applied.

* * * * *